US006803544B1

(12) United States Patent
Zikes et al.

(10) Patent No.: US 6,803,544 B1
(45) Date of Patent: Oct. 12, 2004

(54) IGNITOR DISTINGUISHING CONTROL SYSTEM AND METHOD THEREFOR

(75) Inventors: Bradley C. Zikes, St. Louis, MO (US); Steven DeRousse, Cedar Hill, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/684,177

(22) Filed: Oct. 6, 2000

(51) Int. Cl.[7] ..... F23Q 7/00
(52) U.S. Cl. ..... 219/263; 431/66
(58) Field of Search ..... 219/263, 479, 219/484; 431/13, 66

(56) References Cited

U.S. PATENT DOCUMENTS 4,068,556 A * 1/1978 Foley ..... 89/1.814
4,518,345 A * 5/1985 Mueller et al. ..... 431/24
4,741,692 A * 5/1988 Sadakata et al. ..... 431/258
4,802,414 A * 2/1989 Fiedler et al. ..... 102/206
5,170,042 A * 12/1992 Bunn ..... 219/497
5,357,076 A * 10/1994 Blankenship ..... 219/121.54
5,725,368 A * 3/1998 Arensmeier ..... 431/66
5,911,895 A * 6/1999 Porfido et al. ..... 219/221

FOREIGN PATENT DOCUMENTS

JP 3-251613 * 11/1991

* cited by examiner

*Primary Examiner*—John A. Jeffery
(74) *Attorney, Agent, or Firm*—Harness, Dickey & Pierce, P.L.C.

(57) ABSTRACT

A system and method for universal control of an ignitor within a gas appliance is disclosed. The system includes an ignitor distinguishing circuit in communication with the ignitor and having a signal representative of the ignitor current through the ignitor output therefrom, and a controller in communication with the ignitor distinguishing circuit and adapted to determine the scope of the ignitor based on the signal received from the ignitor distinguishing circuit. Specifically, the controller stores a plurality of control programs for controlling a plurality of corresponding ignitor types and executes the control program corresponding to the type of ignitor determined thereby.

11 Claims, 6 Drawing Sheets

| | SILICONE | SILICONE NITRIDE | SILICONE CARBIDE | SILICONE | SILICONE NITRIDE | SILICONE CARBIDE |
|---|---|---|---|---|---|---|
| | 0-2 SECONDS | | | STEADY STATE | | |
| 97V | 1.92Amps - 2.97Amps | 4.78 Amps – 2.2 Amps | 1.25 Amps-.57Amps | 4.09 Amps | 1.3 Amps | 0.57 Amps |
| 120V | 2.02Amps-4.27Amps | 5.28Amps – 2.38Amps | 1.57 Amps -.82Amps | 5.15 Amps | 1.43 Amps | 0.82 Amps |
| 132V | 1.88Amps – 3.57Amps | 5.65Amps – 2.38Amps | 1.6 Amps - .83 Amps | 5.4 Amps | 1.65 Amps | 0.91 Amps |

FIG. 4

IGNITOR DISTINGUISHING CONTROL SYSTEM AND METHOD THEREFOR

BACKGROUND OF THE INVENTION

The present invention relates generally to a system and method for universal ignitor control, and more particularly to an ignitor distinguishing control system and method therefor.

Most gas furnaces manufactured today include some type of electronic ignition system and, in particular, hot surface ignitors which generate temperatures of about 2,500° F. The system typically includes an ignitor, a gas valve, and a microcomputer and related circuitry. The microcomputer and related circuitry control energizing of the ignitor to a desired ignition temperature. The ignitor, when activated, ignites gas flow passing through the gas valve to the main burner of the furnace without the use of a pilot light. These electric ignition systems increase the efficiency of the furnace, thereby increasing the efficiency of the HVAC system to which they are connected.

Several different types of ignitors exist. The most common types include silicon nitride ignitors, silicon carbide ignitors and mini silicon carbide ignitors. Each type of ignitor behaves differently during the ignitor in-rush and steady states. As a result, each type of ignitor requires a different ignitor control system for controlling operation of the ignitor and ensuring the proper and optimum operation of the furnace.

Currently, there are no means for distinguishing the type of ignitor installed in a furnace. As a result, a different type of ignitor controller is needed for each type of ignitor. Consequently, existing ignitor systems are severely limited in their ability to be used over a variety of ignitor type configurations. Moreover, when an ignitor needs to be replaced, it must be replaced with the same type of ignitor so that the ignitor control system is compatible therewith. Unfortunately, since furnaces are typically used over a long period of time (i.e. 10–20 years), certain ignitor types may no longer be available. Moreover, a new and improved ignitor may have since been developed which is more desirable. Under such circumstances, both the ignitor and the ignitor control system must be replaced.

Accordingly, there is a need for an ignitor distinguishing control system and method whereby one ignitor controller type can be used to control any type of ignitor.

SUMMARY OF THE INVENTION

An ignitor distinguishing control system for distinguishing the type of ignitor within a gas appliance in which the ignitor powered by a power source having a power source voltage, v, connected thereto and an ignitor current having a magnitude is disclosed. The system comprises an ignitor distinguishing circuit in communication with the ignitor and having a signal representative of the ignitor current through the ignitor output therefrom, and a controller in communication with the ignitor distinguishing circuit and adapted to determine the type of the ignitor based on the signal received from the ignitor distinguishing circuit. The igniter operates between an in-rush state having a beginning and an end and a steady state. The controller comprises storage for storing a plurality of control programs for controlling a plurality of corresponding ignitor types and an execution mechanism for executing the control programs corresponding to the type of ignitor determined by the controller. The plurality of control programs comprise a silicon carbide control program, a silicon nitride control programs, and a mini-silicon carbide control programs, and the plurality of corresponding ignitor types comprise a silicon carbide ignitor, a silicon nitride ignitor, and a mini-silicon carbide ignitor, respectively. The controller further comprises a comparator adapted to compare the magnitude of the igniter current of the signal at the beginning of the in-rush state to the magnitude of the ignitor current of the signal at the end of the in-rush state, and the execution mechanism comprises means for executing the silicon carbide ignitor control program when the igniter current compared by the comparator increases between the beginning and the end of the in-rush state. The controller storage also stores an ignitor current value during steady state for each of the plurality of ignitor types and for a plurality of different power source voltages, vp, and the comparator is further adapted to compare the magnitude of the ignitor current of the signal during the steady state with the ignitor current value stored within the controller storage for the power source voltage, vp, equal to the power source voltage, v, of the ignitor distinguishing control system. The execution mechanism executes the control program for the ignitor type having the ignitor current value equal to the magnitude of the ignitor current. The controller further comprises an error message generator for generating an error message to an operator of the appliance if no ignitor type is determined thereby.

A method of distinguishing the type of ignitor within a gas appliance is also disclosed. The method comprises receiving a signal from an ignitor distinguishing circuit connected to the ignitor, and determining the type of ignitor based on the signal received from the ignitor distinguishing circuit. The method may further comprise storing a plurality of control programs for controlling a plurality of corresponding ignitor types and executing the control programs corresponding to the type of ignitor determined. The plurality of control programs comprise a silicon carbide control programs, a silicon nitride control programs, and a mini-silicon carbide control programs, the plurality of corresponding ignitor types comprise a silicon carbide ignitor, a silicon nitride ignitor, and a mini-silicon carbide ignitor, respectively, and the ignitor operates between an in-rush state having a beginning and an end and a steady slate. The method further comprises comparing the magnitude of the ignitor current at the beginning of the in-rush state to the magnitude of the ignitor current at the end of the in-rush state and executing the silicon carbide ignitor control program when the magnitude of the ignitor current increases between the beginning and the end of the in-rush state. The method further comprises storing an ignitor current value during steady state for each of the plurality of ignitor types and for a plurality of power source voltages, vp, comparing the magnitude of the ignitor current of the signal during the steady state with the ignitor current value stored within the controller storage for the power source voltage, vp, equal to the power source voltage, v, of the ignitor, and executing the control program for the ignitor type having the ignitor current value equal to the magnitude of the ignitor current. The method may further comprise generating an error message to an operator of the appliance if no ignitor type is determined.

While the principal advantages and features of the present invention have been explained above, a more complete understanding of the invention may be attained by referring to the description of the preferred embodiments.

BRIEF DESCRIPTION OF THE INVENTION

FIG. 4 is a chart identifying the operating characteristics of various types of ignitors for a plurality of line voltages during the ignitor's in-rush and steady states; and, FIG. 5 and FIG. 6 are flowcharts outlining an ignitor distinguishing control method in accordance with the present invention for distinguishing the type of ignitor in the ignition system of FIG. 1.

DETAILED DESCRIPTION OF PREFERRED ENBODIMENTS

Figure 1:
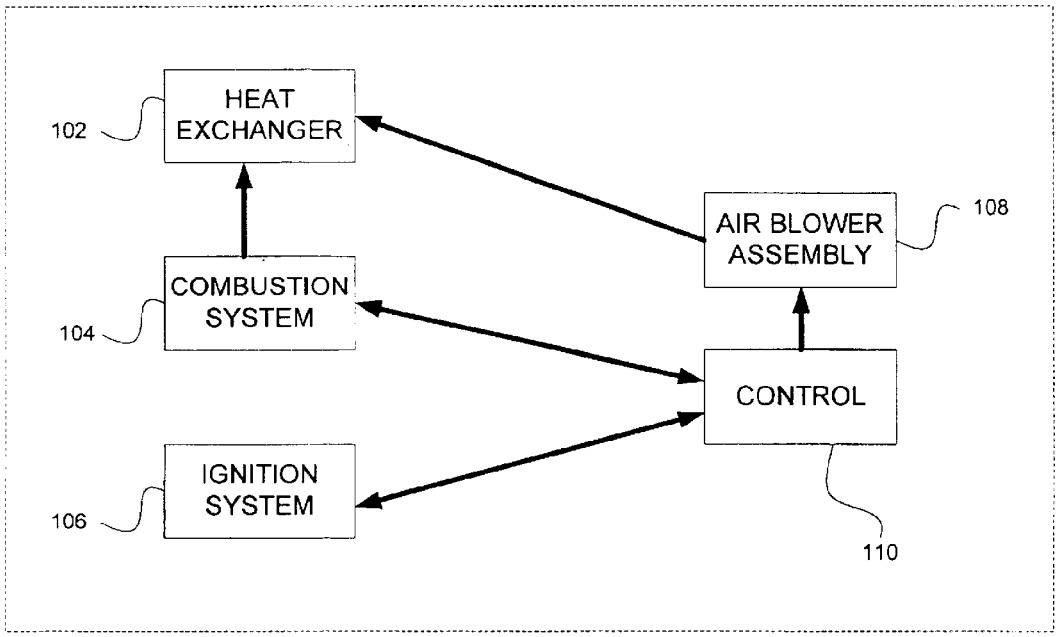
FIG. 1 is a block diagram showing the component parts of a typical furnace for use in connection with a HVAC system in which an ignitor distinguishing control system and method therefor in accordance with the present invention may be implemented.

An ignitor distinguishing control system and method therefor is shown and described in conjunction with a gas furnace incorporating an electronic ignition system. It can be appreciated by one skilled in the art, however, that the ignitor distinguishing control system and method therefor can be provided in conjunction with other types of gas appliances, including without limitation water heaters, boilers, dryers, stoves and ranges. As shown in FIG. 1, a typical gas furnace system 100 includes a heat exchanger 102, a combustion system 104, an ignition system 106, an air blower assembly 108 and an operator control 110, such as a thermostat. Activation of the heating of furnace system 100 requires the opening of a gas valve (not shown) and triggering of an ignitor within the ignition system 106.

Figure 2:
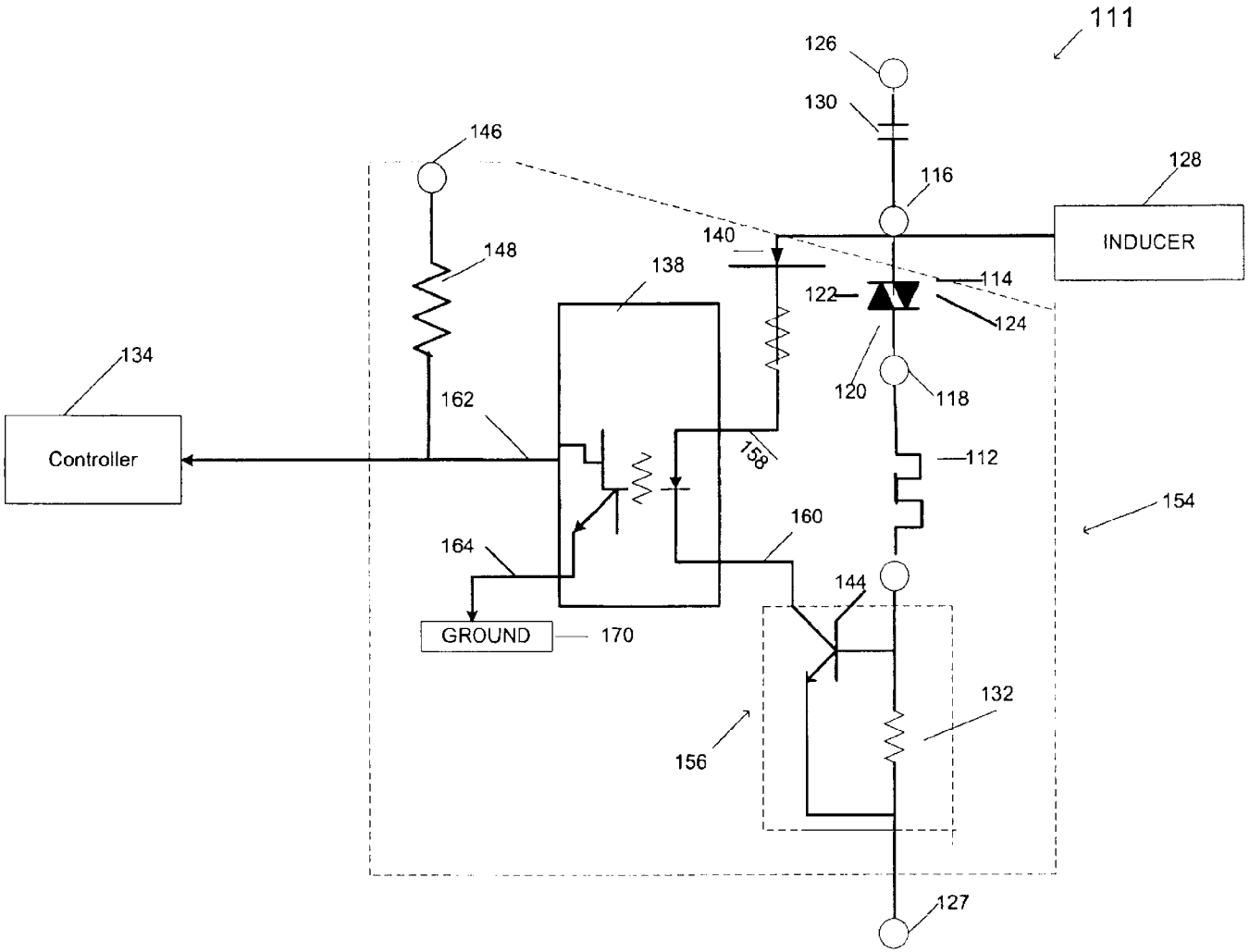
FIG. 2 is a schematic diagram of one embodiment of an ignitor distinguishing control system in accordance with the present invention for use in the ignition system of FIG. 1.

FIG. 2 shows an ignitor distinguishing control system 111 according to one embodiment of the present invention. In particular, an ignitor 112 is powered by a conventional 120 Volt alternating current (AC) power source having power terminals 126 and 127. It is to be understood, however, that power sources of a different voltage, such as for example 97 Volts or 132 Volts may be implemented. The ignitor 112 is controlled by an ignitor switch 114 such as a triac, having terminals 116 and 118. When the voltage on the terminal 116 is positive with respect to the voltage on the terminal 118 and a positive gate voltage is applied to the gate terminal 120 of the switch 114, the left semiconductor 122 conducts. Likewise, when the voltage on the terminals 116 and 118 is reversed and a negative voltage is applied to the gate terminal 120, the right semiconductor 124 conducts. An inducer 128, sometimes also referred to as a purge fan or a combustion air blower, is connected to the power source terminal 126 through normally-open inducer relay contacts 130. The inducer 128 is in air flow communication with the combustion system 104 such that when gas is flowing into the combustion chamber of the furnace (not shown), the inducer 128 provides the air required for developing a combustible air-gas mixture, and provides a positive means for forcing the products of combustion out of the combustion chamber through the flue (also not shown).

A controller 134, preferably in the form of a microprocessor, operates off of a power supply 146, preferably of 5 Volts, in series with a pull-up resistor 148. The controller 134 is connected to the ignitor 112 and the inducer 128 via an ignitor distinguishing circuit 154. The ignitor distinguishing circuit 154 comprises an opto-isolator 138, having a pair of input pins 158 and 160 and a pair of output pins 162 and 164, a current-to-voltage divider 156 connected between the ignitor 112 and the input pin 160 of the opto-isolator 138, and a combination of a diode 140 and a resistor 142 in series and connected between the inducer 128 and the input pin 158 of the opto-isolator 138. Among other functions, the opto-isolator 138 electrically isolates the high voltage components of the ignitor distinguishing control system 111 from its low voltage components. The input pins 158 and 160 of the opto-isolator 138 are connected by a diode 166, while the output pins 162 and 164 of the opto-isolator are connected by a transistor 168. Output pin 162 is connected to the controller 134, while output pin 164 is connected to ground 170. The current-to-voltage divider 156 consists of a resistor 132 connected in parallel with a transistor 144. Transistor 144 has a base 172 connected between the ignitor 112 and the resistor 132, an emitter 174 connected to the power terminal 127 and a collector 176 connected to the input pin 160. Once a sufficient amount of current passes through the ignitor 112 to turn on the transistor 144, a signal representative of that current passes through the opto-isolator 138 and is input to the controller 134.

In one embodiment, the diode 140 is a IN4004 diode, the resistor 142 is a 47 kOhm resistor, the transistor 144 is a MPSA42 transistor, the resistor 132 is a 0.250 Ohm resistor, the igniter switch 114 is a MAC8, the resistor 148 is a 10 kOhm resistor, the opto-isolator 138 is a 4N25, the ignitor 112 is a silicon nitride ignitor, and the controller 134 is a MC68HC705P6. It can be appreciated by one skilled in the art, however, that other types of inducers, ignitors, transistors, controller, and opto-isolators may be implemented.

Figure 3:
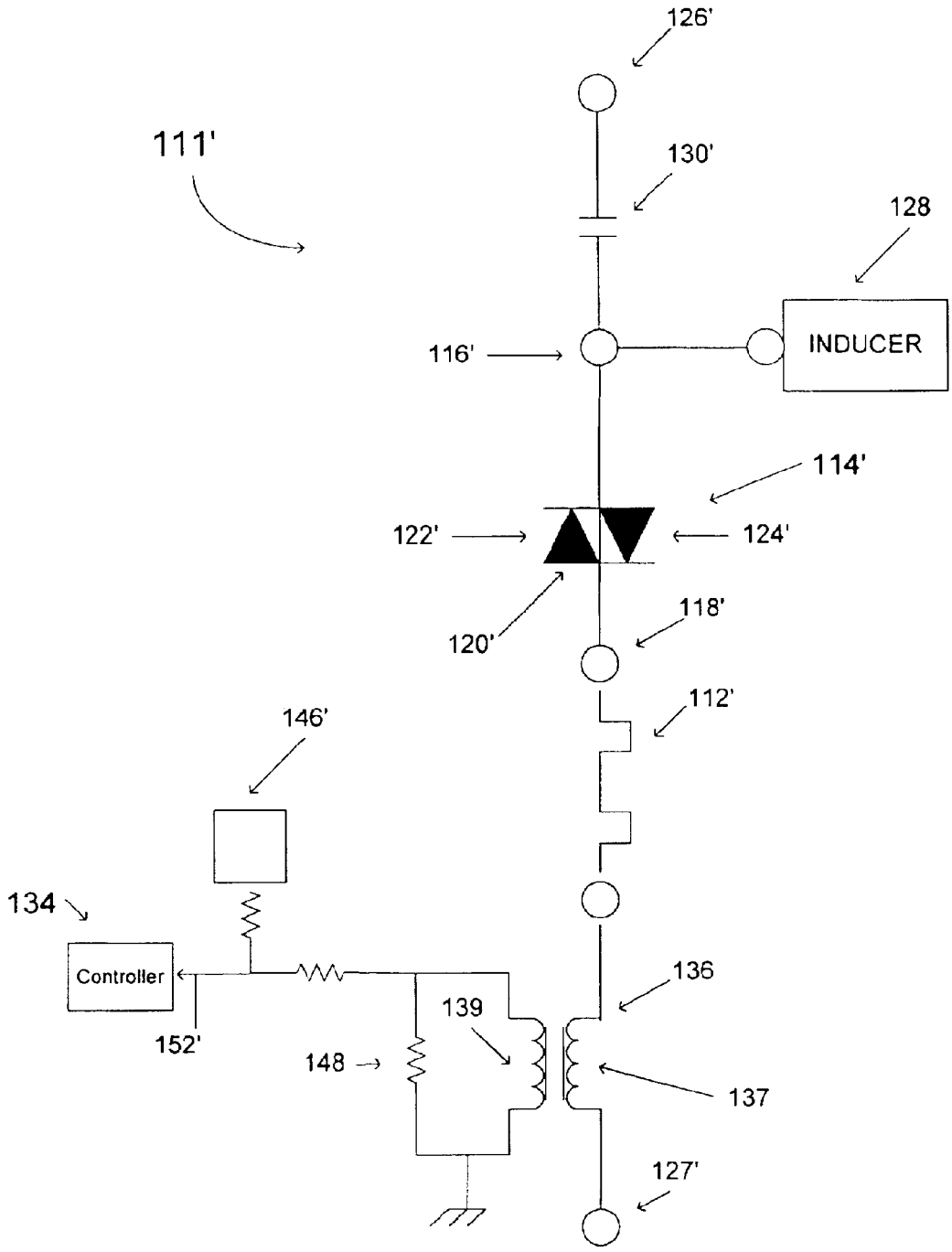
FIG. 3 is a schematic diagram of another embodiment of an ignitor distinguishing control system in accordance with the present invention for use in the ignition system of FIG. 1.

FIG. 3 shows an ignitor distinguishing control system 111', according to another embodiment of the present invention. In particular, an ignitor 112' is powered by a conventional 120 volt alternating current (AC) power source having power terminals 126' and 127'. It is to be understood, however, that power sources of a different voltage, such as for example, 97 Volts or 132 Volts may be implemented. The ignitor 112' is controlled by an ignitor switch 114', such as a triac, having terminals 116' and 118'. An inducer 128' is connected to the power source terminal 126' through normally-open inducer relay contacts 130'. The switch 114' and the inducer 128' operate in a similar manner as those of FIG. 2. A controller 134', preferably in the form of a microprocessor, having an analog-to-digital converter (not shown) operates off a power supply 146', preferably of 5 Volts. It can be understood that the analog-to-digital converter can be provided separate from the controller 134'. The controller 134' is connected to the ignitor 112' via an ignitor distinguishing circuit 154'. The ignitor distinguishing circuit 154' comprises a current-to-voltage divider 156' in series with a voltage divider 150. Current-to-voltage divider 156' includes a transformer 136 having a primary winding 137 in parallel with a secondary winding having a connection to ground. The voltage divider 150 includes a first resistor 180 connected in series with the power source 146' and a second resistor 182 connected in series between the current-to-voltage divider 156' and the microprocessor 134'. The voltage divider 150 acts in part to electrically isolate the high voltage components of the ignitor distinguishing control system 111' from its low voltage components. The voltage divider 150 outputs a signal representative of the current passing through the ignitor 112'.

In one embodiment, the ignitor switch 114' is a MAC8, the controller 134' is a MC68HC705P6, the ignitor 112' is a silicon nitride ignitor, the transformer 136 has a 200 mVolt Amp rating and 1000/1 turns, and the first and second resistors 180 and 182 are 100 KOhm resistors. It can be understood by one skilled in the art that any other types of ignitors, ignitor switches, controller, and transformers may be implemented. While the ignitor distinguishing control systems 111, 111' are shown in two different embodiments, it can be appreciated that any system which can generate a signal representative of the current passing through an ignitor in an ignition system of a gas appliance as an input to a controller in communication therewith and having the functionability described herein can be used. Likewise, while both ignitor distinguishing control systems 111, 111'provide a similar function, due to the varying costs of the different components thereof, one circuit may be more economically favorable than the other.

As shown in FIG. 4, different types of ignitors operate differently during the ignitor in-rush state (i.e., between 0 and 2 seconds of ignition), than during a steady state. For example, with a 97 Volt power source, the current through a silicon carbide ignitor increases from 1.92 Amps to 2.97 Amps during the in-rush state, while the current through the silicon nitride and mini-silicon carbide ignitors decreases during that state; namely from 4.78 Amps to 2.2 Amps and from 1.25 Amps to 0.57 Amps, respectively. The silicon nitride ignitor and the mini-silicon carbide ignitor are further distinguished based on the ignitor current during a steady state. In the case of a 97 Volt power source, the steady state current in a silicon nitride ignitor is greater than that of a mini-silicon carbide ignitor; namely 1.3 Amps versus 0.57 Amps, respectively. The controllers 134, 134' store the information in the table of FIG. 4 in their memory (not shown).

Controllers 134, 134' use the signal input thereto from the ignitor distinguishing circuits 154, 154' and the information of FIG. 4 stored in their memory to determine whether an ignitor is installed and; if so, what type. If no ignitor is installed in the ignition system 106, no signal will be generated from the ignitor distinguishing circuits 154, 154' to the controllers, 134, 134'. If an ignitor is installed, a signal will be generated from which the microprocessor 134, 134' can then determine its type. In the case of the ignitor distinguishing circuit 154 of FIG. 2, the signal is in the form of a square wave, wherein the width of each pulse corresponds to the magnitude of the current through the ignitor 112 per a look-up table. Such a table may equate a pulse width of approximately 7 ms. to 1.25 Amps exemplary of a mini silicon nitride ignitor, or a pulse width of approximately 1 ms. to 5.5 Amps exemplary of a silicon nitride ignitor. In the case of the ignitor distinguishing circuit 154' of FIG. 3, the signal is in the form of a sine wave, wherein the magnitude of the voltage associated therewith corresponds to the magnitude of the current through the ignitor 112' per a look-up table. Such a table may equate a magnitude of 4.5 Volts to 5.5 Amps exemplary of a silicon nitride ignitor or a magnitude of approximately 3.0 Volts to 1.25 Amps exemplary of a mini silicon nitride ignitor. These tables are stored in the controller 134, 134' so that it can calculate the ignitor current therefrom based on the signal received from the ignitor distinguishing circuit 154, 154'. Based on the changes to the ignitor current during the igniter in-rush state and on the magnitude of the ignitor current during the steady state, controller 134, 134', using the information of the table of FIG. 4 stored therein, can determine the type of ignitor installed.

The controller 134, 134' further stores a plurality of control programs for controlling the various types of ignitors of FIG. 4. In the case of a silicon carbide ignitor, controller 134, 134' simply sends a signal to apply the full voltage of the AC power source to the ignitor 112, 112'. Controller 134, 134' stops sending the signal when the ignitor flame is detected or the pre-determined ignitor activation period ends. In the case of either a silicon nitride ignitor or mini-silicon carbide ignitor, a routine as described in U.S. Pat. Nos. 4,925,386 and 4,978,292 and incorporated herein by reference may be used.

Figure 5:
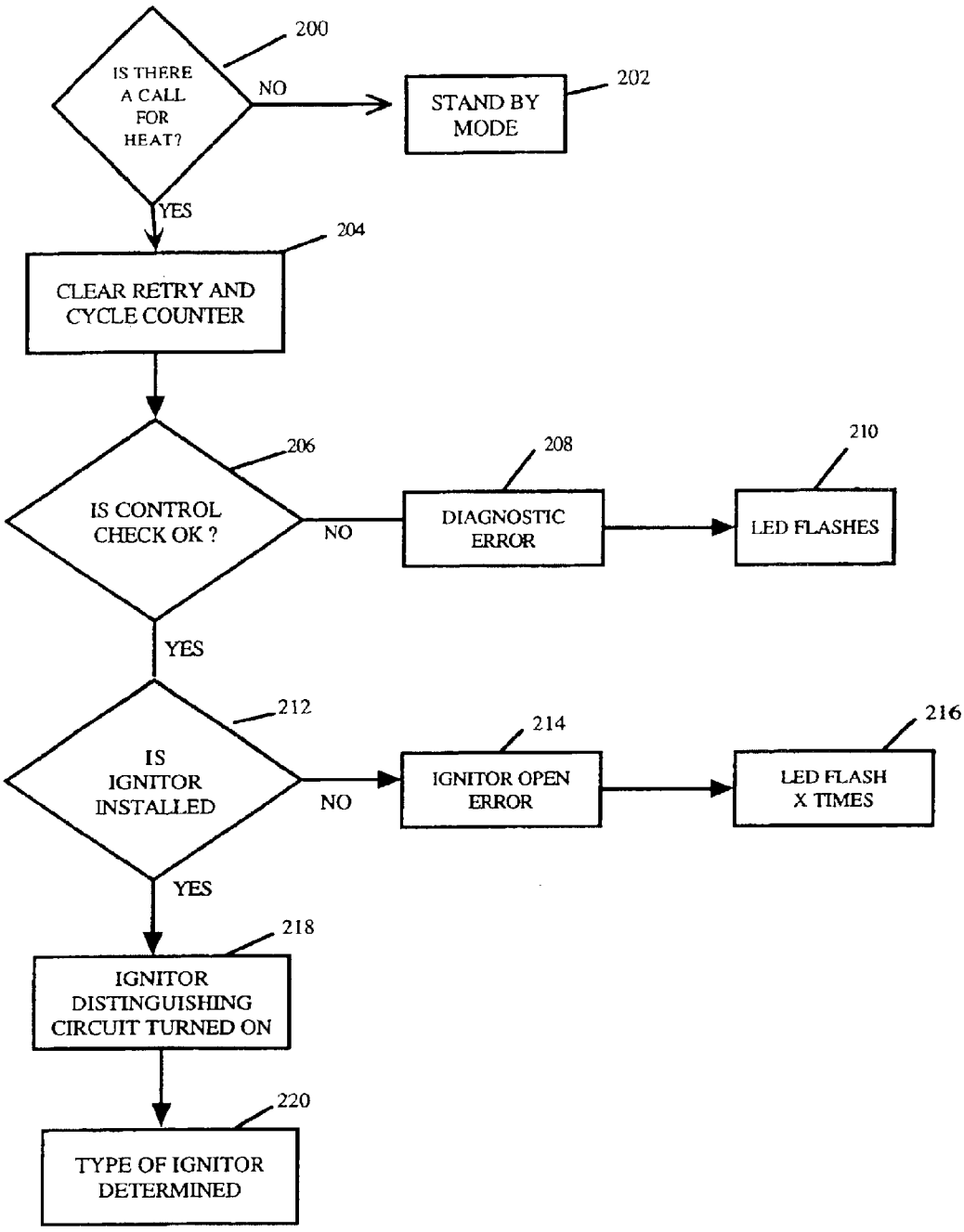

FIG. 5 is a flowchart outlining one preferred method of distinguishing the type of ignition in the ignitor system 106 of FIG. 1 using either ignitor distinguishing control systems 111, 111' of FIGS. 2 and 3, respectively. At 200, the furnace system 100 checks whether there is a request for heat. If not, at 202 furnace system 100 remains in standby mode. If so, at 204, the retry and cycle counters (not shown) of the ignition system 106 are cleared. These counters are used to keep track of the number of times required to light the ignitor 112, 112' or the number of times it is recycled. If the counters exceed a certain predetermined limit, the ignitor system 106 is locked out. At 206, a diagnostic check is made of various components of the furnace system 100 to detect any errors or malfunctions. If such errors or malfunctions are detected, at 208 a diagnostic error is generated by the microcomputer 134, 134' and an appropriate LED of the microcomputer 134, 134' corresponding to the error or malfunction is flashed a predetermined number of times. If no errors or malfunctions are detected, at 212 a check is made whether an ignitor is installed. If not, at 214, controller 134, 134' generates an ignitor error message and at 216, an LED on the microprocessor 134, 134' corresponding to the error flashes on and off for a predetermined number of times.

If an ignitor is installed and once a sufficient amount of current passes through the voltage divider 156, at 218 the ignitor distinguishing circuit 154, 154' is turned on, and at 220, the type of ignitor 112, 112'installed in the ignition system 106 of the furnace system 100 is determined by the microprocessor 134, 134'.

Figure 6:
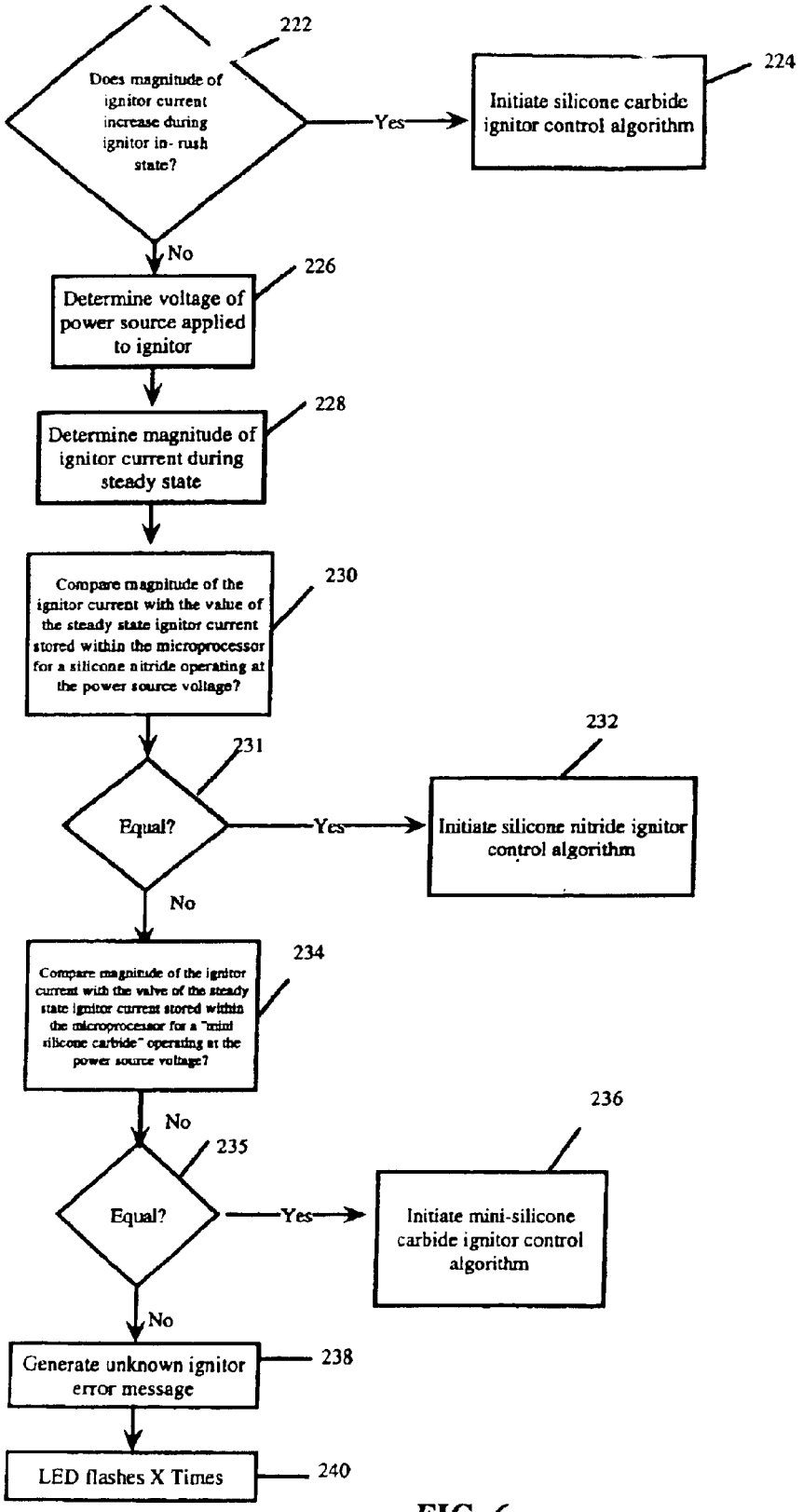

FIG. 6 is a flowchart outlining one preferred method of the step 220 of FIG. 5 for determining the type of ignitor installed in the ignition system 106 of the furnace system 100. At 222, microprocessor 134, 134' determines whether the magnitude of the ignitor current represented by the signal generated from the ignitor distinguishing circuit 154, 154' has increased during the in-rush state of the ignitor 112, 112'. If so, the microprocessor 134, 134' determines that the ignitor 112, 112' must be a silicon carbide ignitor based on the parameters outlined in the table of FIG. 4 and stored within the controller 134, 134'. At 224, microprocessor 134, 134' executes the silicon carbide ignitor control program stored therein accordingly.

If the ignitor current decreases during the in-rush state of ignitor 112, 112', at 226 the controller 134, 134' determines the voltage of the power source applied to ignitor 112, 112' via a voltage measurement circuit (not shown) and at 228, it determines the magnitude of the ignitor current represented by the signal generated by the ignitor distinguishing circuit 154, 154' during the steady state operation of the ignitor 112, 112'. At 230, controller 134, 134' compares the magnitude of the ignitor current with the value of the steady state ignitor current for a silicon nitride operating at the power source voltage stored within the controller 134, 134'. At 231, a check is made whether they are equal. If so, at 232, controller 134, 134' executes a silicon nitride ignitor control program stored therein accordingly. If not, at 234 controller 134, 134' compares the magnitude of the ignitor current with the value of the steady state ignitor current for a mini-silicon carbide ignitor operating at the power source voltage stored within the controller 134, 134'. At 235, a check is made whether they are equal. If so, at 236, controller 134, 134' executes a mini-silicon carbide ignitor control program stored therein accordingly. If not, at 238, the controller 134, 134' generates an unknown ignitor error message, and at 240, a corresponding LED on the controller 134, 134' flashes a predetermined number of times.

The foregoing constitutes a description of various features of a preferred embodiment. Numerous changes to the preferred embodiment are possible without departing from the spirit and scope of the invention. Hence, the scope of the invention should be determined with reference not to the preferred embodiment, but to the following claims.

We claim:

1. An ignitor distinguishing control system for distinguishing the type of ignitor within a gas appliance, the ignitor operating between an in-rush state having a beginning and an end and a steady state, and being powered by a power source having a power source voltage, v, connected thereto, and an ignitor current having a magnitude, the system comprising:

ignitor distinguishing circuit means in communication with the ignitor and having a signal representative of the ignitor current through the ignitor output therefrom; and a controller in communication with the ignitor distinguishing circuit means and adapted to determine the type of the ignitor based on the signal received from the ignitor distinguishing circuit means, the controller comprising storage means for storing a plurality of control programs for controlling a plurality of corresponding ignitor types including at least a silicon carbide control program, a silicon nitride control program, and a mini-silicon carbide control program, and wherein the plurality of corresponding ignitor types comprise a silicon carbide ignitor, a silicon nitride ignitor, and a mini-silicon carbide ignitor, respectively; and execution means for executing the control programs corresponding to the type of ignitor determined by the controller.

2. The ignitor distinguishing control system of claim 1, wherein the controller comprises a comparator adapted to compare the signal from the ignitor distinguishing circuit at the beginning of the in-rush state to the signal from the ignitor distinguishing circuit at the end of the in-rush state, and wherein the execution means comprises means for executing the silicon carbide ignitor control program when the comparison of the signals from the ignitor distinguishing circuit indicates that the ignitor current increased between the beginning and the end of the in-rush state.

3. The ignitor distinguishing control system of claim 2, wherein the storage means comprises means for storing an ignitor current value during steady state for each of the plurality of ignitor types and for a plurality of different power source voltages, vp, and wherein the comparator is further adapted to compare the signal from the ignitor distinguishing circuit during the steady state with the ignitor current value stored within the storage means for the power source voltage, vp, equal to the power source voltage, v, of the ignitor distinguishing control system, and wherein the execution means further comprises means for executing the control program for the ignitor type having the ignitor current value equal to the magnitude of the ignitor current.

4. The ignitor distinguishing control system of claim 2 wherein the controller further comprises error message generation means for generating an error message to an operator of the appliance if no ignitor type is determined thereby.

5. The ignitor distinguishing control system of claim 1, wherein the ignitor has a first terminal and a second terminal, and the controller is a microprocessor, and wherein the ignitor distinguishing circuit means comprises:

an opto-isolator having a first and second input and a first and second output, the first output connected to the microprocessor, the second output connected to a ground, and the first input connected to the first terminal of the ignitor; and a current-to-voltage divider connected between the second terminal of the ignitor and the second input of the opto-isolator.

6. The ignitor distinguishing control system of claim 5, wherein the current-to-voltage divider comprises:

a resistor connected between the second terminal of the ignitor and the power source; and a transistor connected in parallel with the resistor between the second terminal and the second input of the opto-isolator.

7. The ignitor distinguishing control system of claim 1, wherein the ignitor has a first terminal and a second terminal, and the controller is a microprocessor, and wherein the ignitor distinguishing circuit means comprises:

a current-to-voltage divider connected to the second terminal of the ignitor; and a voltage divider connected in series between the microprocessor and the current-to-voltage divider.

8. The ignitor distinguishing control system of claim 7, wherein the current-to-voltage divider comprises:

a transformer having a primary winding and a secondary winding, the transformer connected between the second terminal of the ignitor and the power source; and a resistor connected in parallel with the transformer between the secondary winding of the transformer and the voltage divider.

9. A method of distinguishing of the type of ignitor within a gas appliance, the ignitor powered by a power source having a power source voltage, v, and an ignitor current having a magnitude, the ignitor operating between an in-rush state having a beginning and an end and a steady state, the method comprising:

receiving a signal from an ignitor distinguishing circuit that compares the magnitude of the ignitor current at the beginning of the in-rush state to the magnitude of the ignitor current and the end of the in-rush state; and determining the type of ignitor based on the signal received from the ignitor distinguishing circuit;

executing one of a plurality of control programs for controlling a plurality of corresponding ignitor types, including at least a silicon carbide control program, a silicon nitride control program, and a mini-silicon carbide control program, corresponding to the type of ignitor determined, the silicon carbide ignitor control program being executed when the magnitude of the ignitor current increases between the beginning and the end of the in-rush state.

10. The method of claim 9, further comprising:

storing an ignitor current value during steady state for each of the plurality of ignitor types and for a plurality of power source voltages, vp;

comparing the magnitude of the ignitor current of the signal during the steady state with the ignitor current value stored within the storage means for the power source voltage, vp, equal to the power source voltage, v, of the ignitor; and executing the control program for the ignitor type having the ignitor current value equal to the magnitude of the ignitor current.

11. The method of claim 10, further comprising generating an error message to an operator of the appliance if no ignitor type is determined.

* * * * *